US006032827A

United States Patent [19]

Zettle et al.

[11] Patent Number: 6,032,827

[45] Date of Patent: Mar. 7, 2000

[54] CONTAINER HAVING A SELECTIVELY DETACHABLE LID INCLUDING A RIGID TAB MEMBER

[75] Inventors: Jeffey J. Zettle, Bay City; Donald E. Hodge, Clare; Eric B. Schaper, Midland, all of Mich.

[73] Assignee: S. C. Johnson Home Storage, Inc., Racine, Wis.

[21] Appl. No.: 09/104,743

[22] Filed: Jun. 25, 1998

[51] Int. Cl.[7] ..... B65D 39/00

[52] U.S. Cl. ..... 220/788; 220/784; 220/793; 220/802; 220/805

[58] Field of Search ..... 220/784, 788, 220/790, 791, 793, 801, 802, 805

[56] References Cited

U.S. PATENT DOCUMENTS

| | | | |
|---|---|---|---|
| 3,899,097 | 8/1975 | Aichinger . | |
| 4,293,080 | 10/1981 | Letica . | |
| 4,351,447 | 9/1982 | Graff . | |
| 4,457,447 | 7/1984 | Kirkis . | |
| 4,474,305 | 10/1984 | Marco . | |
| 4,494,674 | 1/1985 | Roof . | |
| 4,555,043 | 11/1985 | Bernhardt . | |
| 4,555,056 | 11/1985 | Bernhardt . | |
| 4,721,210 | 1/1988 | Lawrence et al. . | |
| 4,741,452 | 5/1988 | Holzkopf . | |
| 4,742,934 | 5/1988 | Michaud et al. . | |
| 4,804,092 | 2/1989 | Jones . | |
| 4,819,834 | 4/1989 | Longbottom et al. . | |
| 4,836,407 | 6/1989 | Bruce et al. . | |
| 4,886,184 | 12/1989 | Chamourian . | |
| 4,976,370 | 12/1990 | Cassel . | |
| 5,092,479 | 3/1992 | Wells . | |
| 5,108,768 | 4/1992 | So . | |
| 5,129,517 | 7/1992 | Hustad . | |
| 5,269,430 | 12/1993 | Sclaupitz et al. . | |
| 5,348,181 | 9/1994 | Smith et al. | 220/254 |
| 5,375,719 | 12/1994 | Mittmann et al. . | |
| 5,377,860 | 1/1995 | Littlejohn et al. | 220/784 X |
| 5,507,407 | 4/1996 | Feer et al. . | |
| 5,553,701 | 9/1996 | Jarecki et al. . | |
| 5,577,613 | 11/1996 | Laidlaw . | |
| 5,607,709 | 3/1997 | Fritz et al. . | |
| 5,695,086 | 12/1997 | Viola | 220/287 |
| 5,772,070 | 6/1998 | Hayes et al. | 220/781 |
| 5,860,552 | 1/1999 | Culhane et al. | 220/212 |

FOREIGN PATENT DOCUMENTS

| | | |
|---|---|---|
| 553696 | 7/1974 | Switzerland . |

*Primary Examiner*—Stephen K. Cronin

[57] ABSTRACT

A container including a combination of a bowl and a selectively detachable lid is disclosed. The bowl is a unitary structure including an upwardly projecting wall having a peripherally extending substantially U-shaped sealing lip. The selectively detachable lid is also a unitary structure including a body having a peripheral sealing lip which mates with the sealing lip of the bowl and at least one laterally extending tab member to assist in removing the lid from the bowl. Both the bowl and lid portions are preferably made from a resilient polymeric material suitable for both freezing and microwave reheating.

30 Claims, 3 Drawing Sheets

CONTAINER HAVING A SELECTIVELY DETACHABLE LID INCLUDING A RIGID TAB MEMBER

BACKGROUND OF THE INVENTION

1. Technical Field

The present invention generally relates to a container useful for storing and transporting items such as food and, more particularly, to a container including a bowl and selectively detachable lid including a rigid tab to assist in selectively detaching the lid from the bowl.

2. Description of the State of the Art

Containers, particularly those used for reheating foodstuffs in a microwave oven generally should be relatively low in cost and easy to utilize. Additionally, such containers should be versatile to use, that is, capable of withstanding drastically different environments such as occurs when transferring the container directly from the refrigerator or freezer to a microwave oven, for example.

With regard to these microwavable containers, a primary focus in the art has been on providing a good seal between the lid and the bowl. However, many of the known sealable microwave containers are considered unnecessarily complicated with regard to the sealing assembly. For example, U.S. Pat. No. 5,377,860 requires a specifically shaped double seal arrangement along opposing sides of the sealing rim. According to this reference, the base and the lid both require an inwardly disposed tapering frusto-conical seal area and a downwardly and outwardly extending brim with mating undercuts. While a high integrity seal is accomplished, it is believed that unnecessarily high separation forces would be required to detach the lid from the bowl. This, in turn, makes such containers more prone to spills which is highly undesirable.

The art has in large part failed to consider how the structure of the tab members, particularly when taken in conjunction with the sealing assembly, affects the magnitude of the separation forces required to detach the lid from the bowl. Heretofore, resilient microwavable containers have generally included relatively flimsy tab members (when a tab member is present) which bend at the point of attachment to the lid and thus require unnecessarily high separation forces to detach the lid from the bowl.

OBJECTS AND SUMMARY OF THE INVENTION

It is therefore a primary object of the present invention to provide a container including a bowl and a selectively detachable lid including a sealing arrangement which allows for relatively easy attachment and detachment.

Another object of the present invention is to provide a low cost, high production volume container made from a resilient material.

Still another object of the present invention is to provide a container lid including a structurally reinforced tab which makes the lid readily removable. Yet another object of the present invention is to provide a flared tab member which attaches to a relatively large portion of the lid's sealing lip thereby spreading the separation force over a wide range of the sealing area adjacent the tab.

Still another object of the present invention is to provide a reinforced tab member which resists bending at the point of attachment to the lid and allows for the direct transfer of separation forces from the tab member to the seal region.

Yet another object of the present invention is to provide a resilient container which is useful in various environments such as refrigerator freezers and microwave ovens.

The foregoing objects are achieved by providing a container including a bowl and a selectively detachable lid made from a resilient polymeric material. The lid portion, which generally includes a body having a peripheral sealing lip, includes a rigid tab member extending outwardly therefrom. The tab member is provided with a plurality of spaced apart upstanding ribs designed to maximize the stiffness of the tab to more effectively transfer the separation forces from the tab to the sealing area adjacent the tab. Each of the upstanding ribs are sloped upwardly toward the sealing lip which, in turn, helps make the tab member resistant to bending at the attachment point with the sealing lip.

The containers of the present invention can be economically thermo-formed from any one of a number of known thermoplastic resins including but not limited to polyamides, polyacrylics, polyarylates, polycarbonates, polyesters, polyetherimides, polyetherketones, polyolefins, polyphenylenes, polyvinylchlorides, and various styrene and liquid crystal polymers, among others.

The various features, objects and advantages of the present invention should become still more apparent from a review of the following description of the drawings and invention in detail.

DETAILED DESCRIPTION OF THE INVENTION

Figure 1:
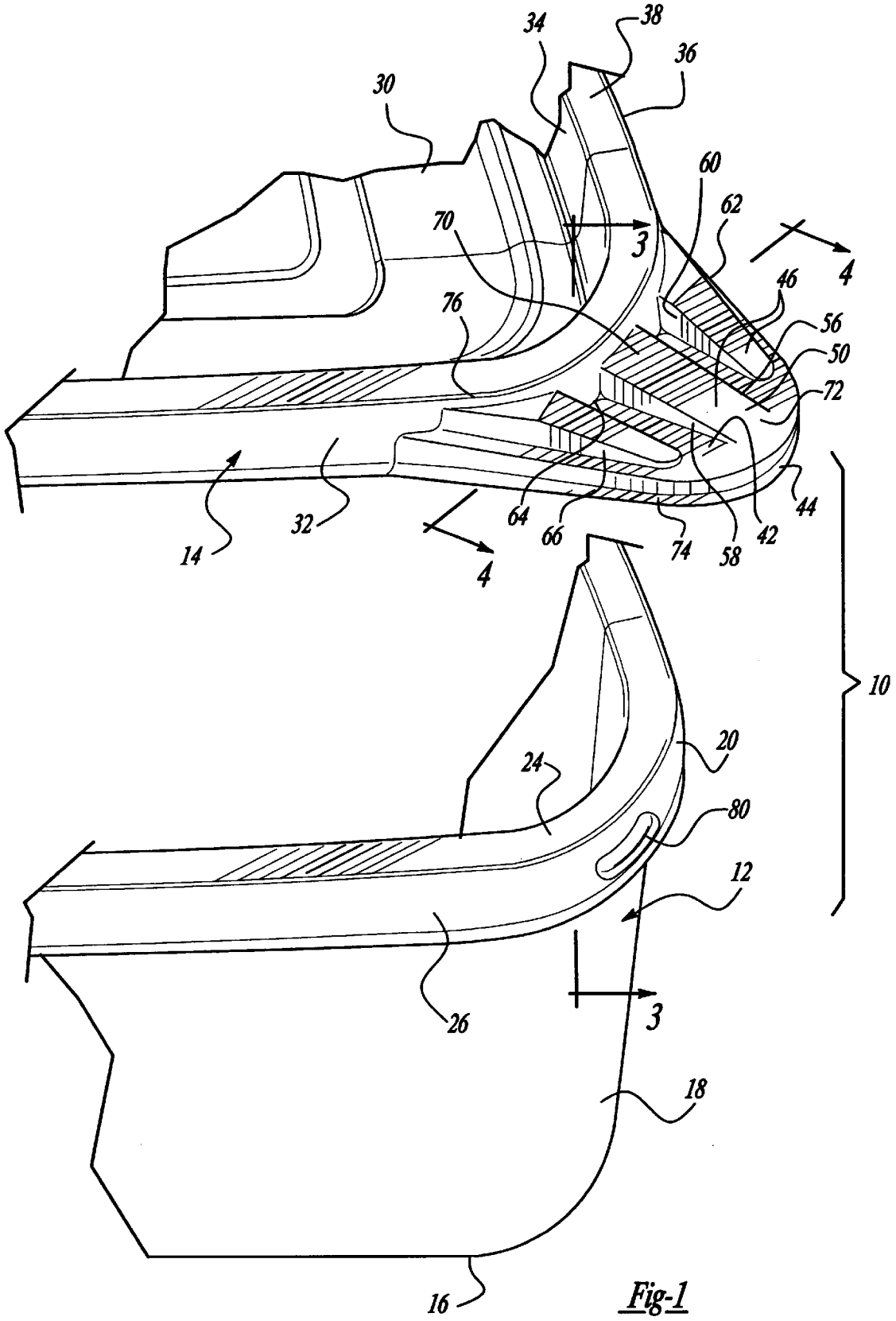
FIG. 1 is an exploded perspective view of a container assembly including a bowl and selectively detachable lid made in accordance with the teachings of the present invention.

Referring generally to FIG. 1, there is shown a container 10 including a bowl 12 and selectively detachable lid 14 formed in accordance with the teachings of the present invention. From the outset, it should be noted that while the container is illustrated generally as being of a rectangular configuration, the container may be of various other configurations such as round, oval or square by way of non-limiting examples.

The bowl 12 generally includes a bottom (not shown) and a continuous side wall 18 extending vertically from the bottom. Integrally connected to the vertically extending sidewall is an L-shaped lip 20 including a first leg 24 which extends outwardly from the sidewall and a second leg 26 which extends downwardly from the first leg. As can be seen more clearly with reference to FIG. 3, the upper portion 22 of the sidewall 18 preferably includes an inwardly extending annular nub 28 which assists in confirming the sealing engagement between the lid and the bowl as will be described in greater detail below.

The lid 14 generally includes a body 30 having a peripherally disposed lip 32 which overlays a portion of the lip 20 provided on the bowl upon attachment. The lip 32 generally has an inverted U-shape cross section including a first leg 34 which extends from the body, a second leg 36 and a web 38 disposed therebetween as shown most clearly in FIG. 3. Thus, upon joining the lid 14 to the bowl 12, the first leg 34 is advanced over the annular nub 28 until the sealing point engages the inner surface of the side wall to provide an interference fit between the lid and bowl. Extending outwardly from the second leg of the lip 32 is a rigid tab member 40 designed to resist bending at the point of attachment to the sealing lip.

Figure 2:
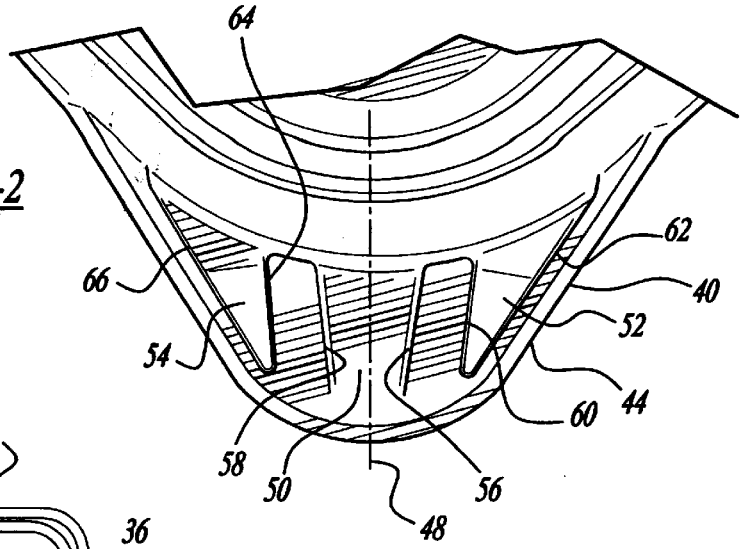
FIG. 2 is a partial top view of a first embodiment of a lid tab in accordance with the teachings of the present invention.

Referring to both FIGS. 1 and 2, the tab member 40 which is substantially triangular in shape is shown as being disposed along a corner of the lid with the tab member including a floor 42 and a peripheral edge 44. The floor 42 is provided with a plurality of spaced apart upstanding ribs 46 including a first rib 50 disposed along a longitudinal center line drawn through the tab as designated by reference numeral 48. Disposed on opposite sides of the first rib, are second and third ribs 52 and 54, respectively, which extend angularly away from the longitudinal center line 48. Each of the ribs are defined by rather abrupt edges which further enhance the structural rigidity of the tab member.

The ribs are positioned at specific locations to maximize the tab's rigidity and thereby enhance the transfer of separation forces from the tab member to the sealing region, i.e., enhance the releasability of the lid from the bowl when desired. For example, the first rib 50 includes a first transverse edge 56 relative to the floor which extends at an angle of between about 3° to about 7° from the longitudinal center line 48 and a second transverse edge 58 extending at an angle of between about −3° to about −7° from the longitudinal center line. Thus, the first rib is generally trapezoidal in shape.

The second rib 52 includes a first transverse edge 60 extending at an angle of between about 8° to about 12° from the longitudinal center line 48 and a second transverse edge 62 extending at an angle of between about 20° to about 40° from the longitudinal center line. The third rib 54 which is the mirror image of the above described second rib 52 extends at an angle of between about −8° to about −12° along a first transverse edge 64 and at an angle of between about −20° to about −40° from the longitudinal center line along a second transverse edge 66. Thus, as shown and described with regard to the preferred angular orientations, the second and third ribs extend angularly away from the longitudinal center line and are substantially triangular in shape.

It should be noted that the negative degree designations (−°) relative to the longitudinal center line are utilized herein for clarity and to emphasize that the second and third ribs are preferably mirror images of each other. As such, one skilled in the art should readily recognize, for example, that −3° is equivalent to 357° and −7° is equivalent to 353° utilizing standard radius expressions.

According to a preferred embodiment, each of the upstanding ribs include a first end 70 terminating proximate to the lip 32 and a second end 72 terminating proximate to the peripheral edge 44 of the tab. The upstanding ribs are generally sloped upwardly from the second end to the first end at an average inclination of between about 12° to 18° such that the ribs join the lip 32 near the junction 76 between the web 38 and second leg 36. The peripheral edge of the tab member preferably includes a downturned flange 74 which extends below the floor 42 and thus provides a barrier to prevent a user's thumb or finger from sliding off of the tab member.

As should be understood by those skilled in the art, the angular and sloping orientation of the upstanding ribs provide the tab member with the desired stiffness to resist bending, particularly at the point of attachment with the sealing lip. This in turn allows for a high transfer of the separation forces from the tab member to sealing lip to more easily overcome the interference fit which is desirable.

Figure 3:
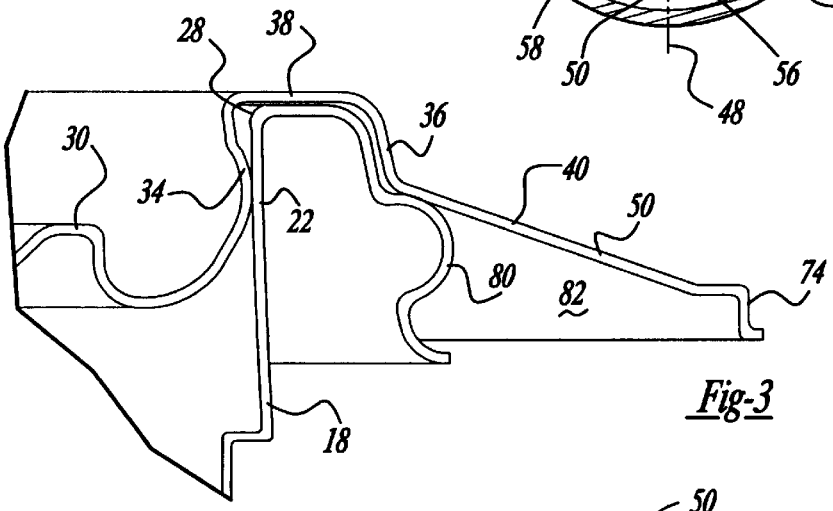
FIG. 3 is a sectional view taken along line 3—3 of FIG. 1, showing the lid including a tab member having a detent which is engaged by a protrusion extending from the bowl in accordance with the teachings of one embodiment of the present invention.
Figure 4:
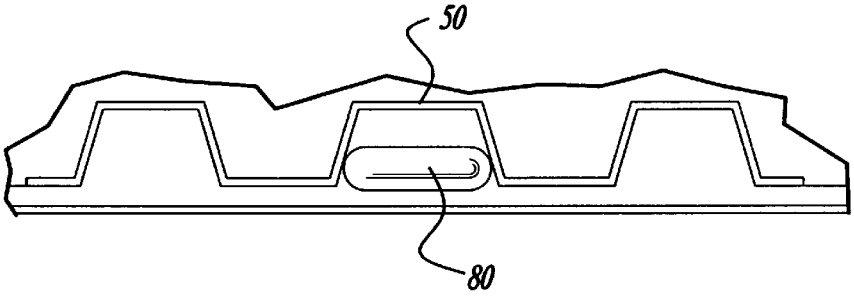
FIG. 4 is a sectional view taken along line 4—4 of FIG. 1.
Figure 6:
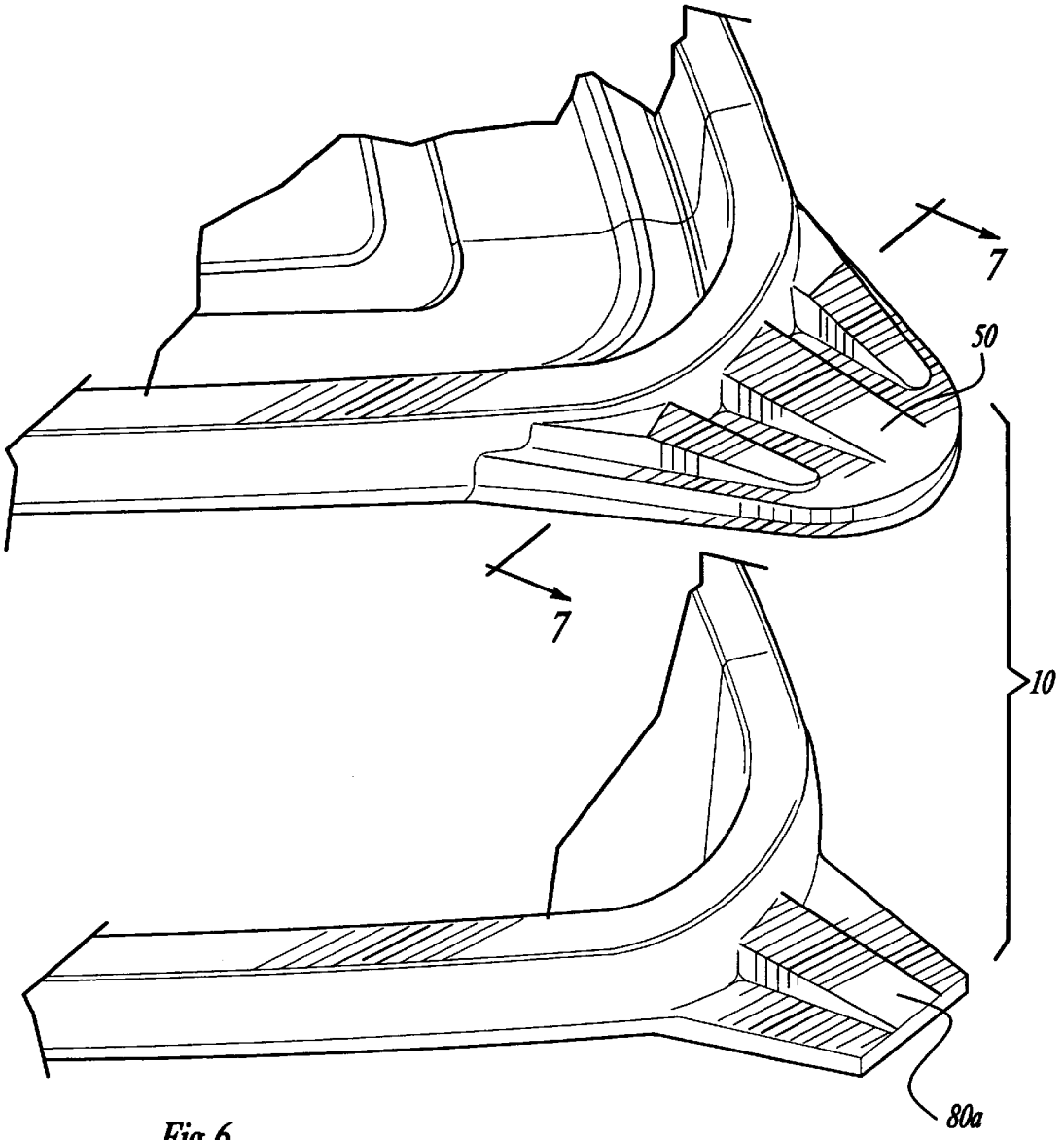
FIG. 6 is a perspective view of a lid including a tab member which engages a protrusion extending from the bowl's lip in an overlapping manner, in accordance with a third embodiment.
Figure 7:
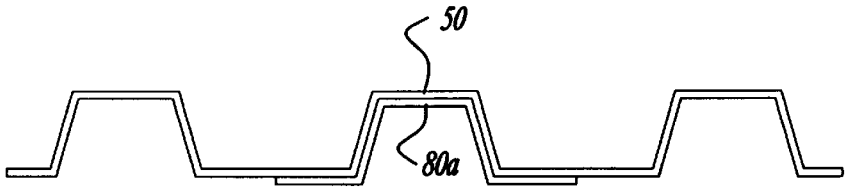
FIG. 7 is a sectional view taken along line 7—7 of FIG. 6.

Referring to FIGS. 3 and 4, the second leg 26 of the bowl's lip 20 may optionally be provided with an outwardly extending protrusion 80 which seats within a detent 82 provided on the underside of the first rib 50. Further, as shown in FIGS. 6 and 7, a mini-tab 80A may be shaped to conform to the detent occurring on the underside of the first rib 50 such that the tab member 20 engages the protrusion in an overlapping manner.

Figure 5:
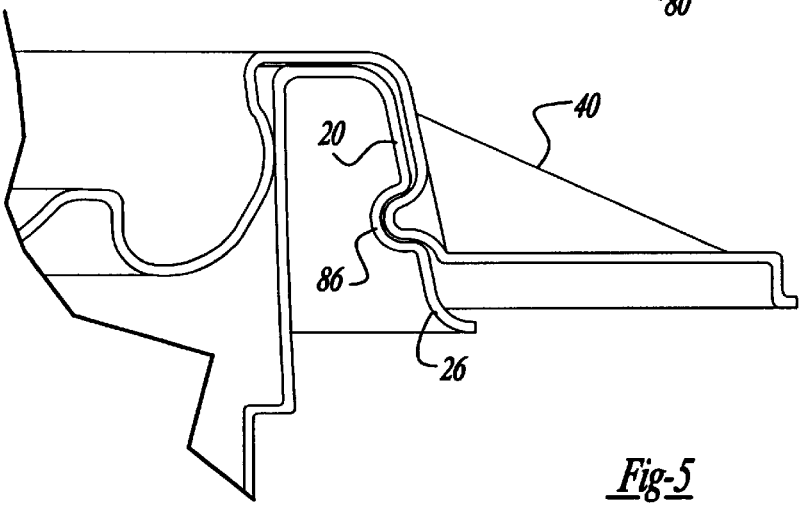
FIG. 5 is a sectional view of a container including a lid having a tab member including a protrusion which engages a recess occurring on the bowl's lip, in accordance with a second embodiment.

Alternatively, as illustrated in FIG. 5, the tab member 40 may optionally be provided with one or more protrusions 84 extending in the direction of the sidewall which engages a recess 86 provided on the second leg 26 of the bowl's lip 20. For example, the protrusions 84 would extend from the lip portion occurring along the recessed areas disposed on opposite sides of centerline 48 where two protrusions are employed. Under each of the embodiments depicted in FIGS. 3–7, means for aligning the lid relative to the bowl and verifying that a sufficient connection has been accomplished to obtain the interfit seal is provided. Thus, if the protrusion or mini-tab fails to seat within the respective recess or detent, the lid is not properly attached and therefore provides an indication that the interfit seal will not be established.

As noted, while the lid and bowl may be thermo-formed from any one of a number of different polymeric materials, a polypropylene homopolymer optionally including a slip agent is considered to be preferable. By utilizing a polypropylene homopolymer, the lid and bowl can be thermoformed to have an average thicknesses of between about 10 to 50 mils and still offer the necessary structural integrity.

While it will be apparent that the preferred embodiments of the invention disclosed are well calculated to fulfill the objects stated, it will be appreciated that the invention is susceptible to modification, variation and change without departing from the spirit thereof.

What is claimed is:

1. A lid for a container, said lid comprising:

a body and a peripheral sealing lip extending from said body; and a substantially triangular shaped rigid tab member integrally extending from said sealing lip including a floor and a peripheral edge, said floor including a plurality of spaced apart upstanding ribs including a first rib disposed along a longitudinal center line and at least one other rib extending angularly away from said longitudinal center line.

2. The lid of claim 1 wherein said upstanding ribs include a first end terminating proximate to said sealing lip and a second end terminating proximate to the peripheral edge of said tab member.

3. The lid of claim 2, wherein said upstanding ribs are sloped upwardly from said second end to said first end.

4. The lid of claim 2, wherein said upstanding ribs are sloped at an average indication of between about 12° to 18°.

5. The lid of claim 1 wherein said first rib includes a first edge extending at an angle of between about 3° to about 7° from said longitudinal center line and a second edge extending at an angle of between about −3° to about −7° from said longitudinal center line.

6. The lid of claim 5 wherein said third rib includes a first edge extending at an angle of between about −8° to about −12° from said longitudinal center line and a second edge extending at an angle of between about −20° to −40° from said longitudinal center line.

7. The lid of claim 1, wherein said at least one other rib includes second and third substantially triangular shaped ribs disposed on opposite sides of said first rib.

8. The lid of claim 7 wherein said second rib includes a first edge extending at an angle of between about 8° to about 12° from said longitudinal center line and a second edge extending at an angle of between about 20° to 40° from said longitudinal center line.

9. The lid of claim 1 wherein said peripheral edge of said tab member includes a flange extending below said floor.

10. The lid of claim 1, wherein said peripheral sealing lip has an inverted U-shape in cross section.

11. The lid of claim 1, wherein said tab member includes a projection which engages a recess on said bowl.

12. The lid of claim 1, wherein said tab member includes a detent which is engaged by a protrusion extending from said bowl.

13. The lid of claim 12, wherein said tab member overlaps a mini-tab protrusion extending from said bowl.

14. A microwavable container comprising:

a bowl including a bottom, a continuous side wall extending upwardly from said bottom and an L-shaped lip extending from said side wall; and a selectively detachable lid including a body having a peripheral sealing lip and a rigid tab member extending from said sealing lip;

said tab member including a floor having a plurality of upstanding ribs including a first rib disposed along a longitudinal center line including a first edge extending at an angle of between about 3° to about 7° from said longitudinal center line and a second edge extending at an angle of between about −3° to about −7° from said longitudinal center line, a second rib including a first edge extending at an angle of between about 8° to about 12° from said longitudinal center line and a second edge extending at an angle of between about 20° to 40° from said longitudinal center line, and a third rib including a first edge extending at an angle of between about −8° to about −12° from said longitudinal center line and a second edge extending at an angle of between about −20° to −40° from said longitudinal center line.

15. The container of claim 14 wherein said upstanding ribs include a first end terminating proximate to said sealing lip and a second end terminating proximate to the peripheral edge of said tab member.

16. The container of claim 15, wherein said upstanding ribs are sloped upwardly from said second end to said first end.

17. The lid of claim 16, wherein said upstanding ribs are sloped at an average indication of between about 12° to 18°.

18. The container of claim 14, wherein the body of said tab member is substantially triangular in shape.

19. The container of claim 16, wherein said tab member includes a peripheral edge having a downturned flange.

20. The container of claim 14, wherein said tab member includes a projection which engages a recess on said bowl.

21. The container of claim 14, wherein said tab member includes a detent which is engaged by a protrusion extending from said bowl.

22. The container of claim 14, wherein said tab member overlaps a mini-tab extending from said bowl.

23. A lid for a container including at least one corner, said lid comprising:

a body and a peripheral sealing lip extending from said body; and a rigid tab member integrally extending from said sealing lip along a lid corner, said tab member including a floor and a peripheral edge, said floor including a plurality of spaced apart upstanding ribs including a first rib disposed along a longitudinal center line and at least one other rib extending angularly away from said longitudinal center line.

24. The lid of claim 23 wherein said upstanding ribs include a first end terminating proximate to said sealing lip and a second end terminating proximate to the peripheral edge of said tab member.

25. The lid of claim 24, wherein said upstanding ribs are sloped upwardly from said second end to said first end.

26. The lid of claim 24, wherein said upstanding ribs are sloped at an average indication of between about 12° to 18°.

27. The lid of claim 23 wherein said first rib includes a first edge extending at an angle of between about 3° to about 7° from said longitudinal center line and a second edge extending at an angle of between about −3° to about −7° from said longitudinal center line.

28. The lid of claim 23, wherein said at least one other rib includes second and third substantially triangular shaped ribs disposed on opposite sides of said first rib.

29. The lid of claim 28 wherein said second rib includes a first edge extending at an angle of between about 8° to about 12° from said longitudinal center line and a second edge extending at an angle of between about 20° to 40° from said longitudinal center line.

30. The lid of claim 23 wherein said third rib includes a first edge extending at an angle of between about −8° to about −12° from said longitudinal center line and a second edge extending at an angle of between about −20° to −40° from said longitudinal center line.

* * * * *

UNITED STATES PATENT AND TRADEMARK OFFICE

CERTIFICATE OF CORRECTION

PATENT NO. : 6,032,827
DATED : March 7, 2000
INVENTOR(S) : Jeffrey J. Zettle et al.

It is certified that error appears in the above-identified patent and that said Letters Patent is hereby corrected as shown below:

Title page,
Item [75], Inventors:
Please delete "Jeffey" J. Zettle and change to -- Jeffrey -- J. Zettle Signed and Sealed this Second Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,032,827
DATED : March 7, 2000
INVENTOR(S) : Zettle et al.

It is certified that error appears in the above-identified patent and that said Letters Patent is hereby corrected as shown below:

In the identification of the inventors, replace [Jeffey] with Jeffrey.

Claim 19,
Line 1, replace [16] with 14.

Signed and Sealed this

Fourth Day of December, 2001

*Attest:*

Nicholas P. Godici

NICHOLAS P. GODICI
*Acting Director of the United States Patent and Trademark Office*

*Attesting Officer*